US009724557B2

(12) United States Patent
Wilson

(10) Patent No.: US 9,724,557 B2
(45) Date of Patent: Aug. 8, 2017

(54) EXERCISE APPARATUS

(71) Applicant: Alan Clifford Wilson, Denver, CO (US)

(72) Inventor: Alan Clifford Wilson, Denver, CO (US)

( * ) Notice: Subject to any disclaimer, the term of this patent is extended or adjusted under 35 U.S.C. 154(b) by 63 days.

(21) Appl. No.: 14/920,876

(22) Filed: Oct. 23, 2015

(65) Prior Publication Data

US 2017/0113090 A1 Apr. 27, 2017

(51) Int. Cl.

*A63B 21/00* (2006.01)
*A63B 21/22* (2006.01)
*A63B 23/02* (2006.01)

(52) U.S. Cl.

CPC ..... *A63B 21/22* (2013.01); *A63B 21/4035* (2015.10); *A63B 21/4049* (2015.10); *A63B 23/0211* (2013.01); *A63B 23/0222* (2013.01); *A63B 23/0233* (2013.01)

(58) Field of Classification Search

CPC ..... A63B 22/14; A63B 22/18; A63B 23/1218; A63B 5/08; A63B 5/11; A63B 21/00181; A63B 21/015

See application file for complete search history.

(56) References Cited

U.S. PATENT DOCUMENTS 4,477,070 A * 10/1984 Appelbaum ..... A63B 69/0035 482/28
4,538,807 A * 9/1985 Rice ..... A63B 22/14 482/133
4,836,530 A * 6/1989 Stanley, Jr. ..... A63B 5/11 482/27
5,171,196 A 12/1992 Lynch
5,273,502 A 12/1993 Kelsey et al.
5,372,561 A 12/1994 Lynch
5,662,560 A 9/1997 Svendsen et al.
6,450,923 B1 9/2002 Vatti
2009/0152059 A1* 6/2009 Womack ..... A63B 21/00069 188/266
2011/0281701 A1* 11/2011 Zhang ..... A63B 22/14 482/146
2011/0287914 A1* 11/2011 Morris ..... A63B 21/00069 482/147

* cited by examiner

*Primary Examiner* — Sundhara Ganesan
*Assistant Examiner* — Jennifer M Deichl
(74) *Attorney, Agent, or Firm* — Roger A. Jackson

(57) ABSTRACT

An exercise apparatus and method for rotational and vertical movement, the exercise apparatus including a base with a stabilizing foot extending substantially perpendicular to the lengthwise axis, further included is a support beam having proximal and distal end portions, wherein the proximal end extends from the base. Also included is a suspension handle that is disposed adjacent to the distal end and a pivotally attached platform attached to the base. Wherein operationally, on the exercise apparatus an individual standing on the platform can simultaneously grasp the suspension handle to initiate a whole body twisting motion via a pivotal movement of the platform situated as between the suspension handle and the pivoting platform with the ability to add a pull up exercise using the suspension handle, wherein the suspension handle provides added stability and support to the individual for effecting a soft skeletal joint vertical support that is variable at will.

9 Claims, 9 Drawing Sheets

EXERCISE APPARATUS

TECHNICAL FIELD

The present invention generally relates to an apparatus for accomplishing exercise typically in a traditional exercise or working out environment, either in the home or commercial gym. More particularly, the present invention is an exercise apparatus that is adapted to be adjacent to a pivotally attached foot platform or a means for rebounding that an individual uses in a home or commercial gym environment to facilitate exercise in a convenient time and place, thus allowing the individual to enjoy the health benefits of exercise when circumstances don't readily allow for the time and expense of exercising in an outdoor environment, such as running, bicycling, and the like, as opposed to using a traditional exercise facility, such as a gym, health club, spa, pool, and so forth.

BACKGROUND OF INVENTION

The health benefits of exercise are well known and applicable to all ages of individuals, including cardiovascular improvement, muscle strengthening, stretching, increased blood circulation, better coordination, sharper motor abilities, flexible joint mobility, bone health, general overall wellness, and the like. One problem as an individual typically moves from being a child to being an adult, their physical activity levels decline just when maintaining good health is at its most important as an individual ages, typically their exercise levels decline that can work against maintaining good health, thus just when an individual should be exercising and being active, their exercise and activity levels tend to decrease.

Children are normally active in going places (i.e. walking or riding a bike), playing active games in their spare time, such as football, soccer, baseball, tag, hide and seek, and the like, plus being in school, children are also active in physical education classes and after school hours sports leagues. Thus as children we are normally plenty active and in the best of health due to our young age. However, as we become adults, societal norms tend to drive us into a much more sedentary lifestyle, for instance by having a car, we tend to walk very little, nor ride a bicycle much, and as an office worker we tend to sit at a desk for long periods of time, sit in meetings, sit on airplanes, and then go out for high fat and calorie content meals at high end restaurants, thus as a result most adults tend to gain weight by consuming more calories coupled with a lower activity lifestyle, just when our bodies should be in better shape to compensate for aging we typically get in worse shape.

Although the benefits of exercise especially for adults are acknowledged by most everyone for weight control, maintaining agility, preventing diabetes, preventing joint strain from excessive body weight, preventing higher various internal organ workloads (especially the heart) from excessive body weight, and so on, few adults are active enough to maintain even a recommended weight, typically being only about one-fourth of the adult population is not overweight, thus an overwhelming majority of adults are overweight. So the question to ask is, why don't the majority of adults exercise especially if the health benefits are widely known?

One probable answer is that available time and convenience are a problem for engaging in an exercise program, as most adults have a full time job, a family, and other interests that all together consume most of an adult's time, this is in addition to boredom and the constant obligation of regular exercise placed upon an individual's time. Wherein, even the adults who engage in exercise programs, especially after new years in January-typically lose interest in a short amount of time, wherein this "petering-out" of individual's exercise program is acerbated by the long term slow rate of actual physical shape (endurance, strength, and appearance) improvement. Thus, a potentially helpful solution is to minimize the time, boredom, and convenience obstacles to allow for an exercise program to be more possible for a working adult on a long term basis.

In looking at the prior art in this area of exercise machines that attempt make exercise or physical rehabilitation easier, more effective, involving additional muscles, or less strenuous, for example in U.S. Pat. No. 6,450,923 to Vatti disclosed is an apparatus and methods for enhanced exercises and back pain relief, thus helping to decrease exercise boredom and increase comfort. People suffering from back pain in Vatti would be able to use the apparatus more effectively to relieve the pain. This apparatus in Vatti can also be used by common users for strengthening and stretching exercises that conventional exercising equipment such as treadmills do not provide. Combinations of a general frame in Vatti along with multiple attachments form an effective exercising apparatus. The user of the Vatti apparatus shifts weight from the spine or lower back to the hands while performing exercises.

Wherein, an ordinary upright user position causes more stress on the lower back and the weight of the upper body in motion may make the situation worse, say for instance on a typical treadmill. By suitable placement of hands and selectively distributing upper body weight to hands in Vatti, the user would be able to control the amount of weight reduction on the lower back or spine as needed to achieve the best results and comfort. Basically, Vatti combined a conventional treadmill with a number of attachments for exercising a user's arms and legs for additional exercises plus having upper body support while on the treadmill, however, not teaching any specifics related to adjustment or criterion setting, i.e. amount of upper body support.

Continuing in this area of exercise machine prior art, in U.S. Pat. No. 5,662,560 to Svendsen, et al., disclosed is a therapeutic bilateral weight unloading apparatus which suspends a user to support a selected portion the user's weight while reducing and dampening both vertical and lateral forces that are exerted on the user while standing or exercising. The apparatus in Svendsen, et al., suspends the user between two independently supported boom arms, with the independent action of the boom arms gently counter balances the user's natural weight shifts to reduce and dampen both the vertical and lateral forces exerted on the suspended user while standing or exercising, thus the dampening is applied to the entire user's body from a torso stabilizing harness.

The unloading apparatus Svendsen, et al., includes a frame and two pivoting boom arms that are independently supported by two gas compression springs with the user being completely suspended between the boom arms by a body harness. The boom arms Svendsen, et al., are pivotally connected to a vertically adjustable gantry frame extensibly mounted to a base frame, which allows the boom arms to be raised and lowered. The gas springs Svendsen, et al., provide the upward suspension force used to support a selected portion of the user's weight, further one end of the gas springs is connected to a slide collar shiftably mounted to each of the boom arms. Each slide collar Svendsen, et al., can be selectively positioned along the length of the boom arm to adjust the suspension force for each boom arm, in addition, the base frame may be fitted with casters, which allows the apparatus to be moved by the suspended user, see column 1, lines 43-67.

Svendsen et al., has disadvantages in requiring a user fitted unique harness, plus the discomfort from heavy physical activity, i.e. sweating/chaffing while the user is in the harness, as basically Svendsen, et al., is specifically designed for the user who needs total vertical support while on a treadmill for instance, in other words the user could completely collapse in Svendsen, et al., apparatus and still be completely suspended above the treadmill. Also, as in Vatti, there is no teaching in Svendsen, et al., related to adjustment or criterion setting, i.e. amount of upper body support.

Continuing in this prior art area in U.S. Pat. No. 5,372,561 to Lynch being configured similar to Svendsen et al., Lynch discloses an apparatus for whole user body suspension assisted ambulation to provide a vertically moveable gantry frame in conjunction with a treadmill with attachment points on the gantry frame which allow attachment of an upper-body harness so as to suspend a person so that the person can ambulate with less than gravitational weight on their lower extremities. The exercising device in Lynch comprises a treadmill, a vertical support frame affixed to such treadmill, a gantry frame pivotally attached to the vertical support frame, and an upper-body harness suspended from solid gantry frame; see column 2, lines 47-68. Pneumatic linear actuators are pivotally connected to Lynch in the vertical support frame and the gantry frame and regulated air pressure may be introduced into the pneumatic linear actuators to effect a rotational movement to the gantry frame in relation to the support frame and thus exert an upward force on the upper-body harness.

The magnitude of the vertical force in Lynch exerted on the upper-body harness is a function of the regulated air pressure. By regulating the air pressure in Lynch the user/operator can vary the uplift force applied to meet the requirements of each subject so that individuals who only need to be stabilized can ambulate with near full weight on their feet and where individuals who cannot tolerate full weight on a lower extremity joint may have the joint load reduced by a substantial percentage of their body weight. The use of air pressure in Lynch to actuate the upper-body suspension system allows it to instantly adjust to the vertical translational excursion of the body that occurs during ambulation and thus preclude oscillating shocks being induced to the user.

The control in Lynch of the various parameters of the machine, (belt speed, uplift force, and time) are preferably controlled, monitored and recorded by a computer, see column 3, lines 1-28. Lynch, does finally get into some criterion for upward force on the user's body through the use of regulating air pressure, however, there is a lack of specifics as to what relationship the upward force to have to other parameters of user weight, speed, condition, support type, etc, instead there are just a set of typical or arbitrary percentages of upward force, see column 6, lines 16-36. Further, in Lynch the use of air pressure in a cylinder is not good design, as the ability hold a position of the harness and thus upward force is unreliable due to air leakage and not having a positive suspension lock, i.e. a screw block type, plus if the compressor were to fail, the user would be suddenly dropped, potentially causing injury. Note that Lynch supports the entire user's body through a torso harness also much like Svendsen et al., not allowing for a contemporaneous dampened grasp by the user.

Further continuing in this prior art area U.S. Pat. No. 5,273,502 to Kelsey, et al. again is a harness type support for the entire user's body weight, see Lynch and Svendsen et al., in Kelsey et al., disclosed is a therapeutic apparatus and method including a frame to which a winch is mounted. A spring in Kelsey, et al., is attached at one end to the winch and at the other end to a support harness; also a load cell is connected to the winch so that the winch automatically maintains a set load while the load varies back and forth from more than to less than the set load. Cables interconnect the winch, spring and harness in a preferred embodiment in Kelsey, et al. Further, the support frame in Kelsey, et al. is preferably comprised of a pair of oppositely positioned strength beams, wherein these beams are interconnected by means of a transverse support within which is an opening from which the harness cable descends so that when a user wears the harness the user is supported from the transverse support from above; see column 2, lines 6-22.

The support harness in Kelsey, et al. includes a waist encircling abdominal strap that "grasps" the user very snugly so that there is no shifting of the abdominal strap as strain is taken on the support cable, i.e. as the user is "unloaded." A pair of arm loops in Kelsey, et al. is attached at opposite sides to the waist encircling abdominal strap and from those arm loops a corresponding pair of harness cable connectors is attached and these two connectors are attached to a single harness bar at the bar's opposite ends. The center of the bar is connected to the harness cable at the mid-point of the bar so that as the user is "unloaded," weight is lifted evenly on both sides of the user through the encircling abdominal strap, as a result the user is lifted precisely, evenly, and accurately, see column 2, lines 37-50. Kelsey et al., through the use of a kinematic system including a magnetic clutch and low spring constant change spring attempts to have a constant upward force exerted upon the user in a physical rehab type environment, although this system would seem to have a "pogo-stick" effect by not having any dampening, i.e. constantly yanking the user up and down due to reactionary changes in the winch movement that are amplified by the clutch and spring, i.e. leading to undesirable mechanical dynamic resonance of the system that would be discomforting to the user by being continually oscillating vertically.

Nest, in the exercise machine arts for a combination of exercise movements in U.S. Pat. No. 5,171,196 to Lynch discloses the dispensing of the user harness, that the previous Lynch '561 had, wherein Lynch '196 discloses a treadmill with variable upper body resistance loading to provide two, or more, sets of upper body exercising levers, in conjunction with an inclinable treadmill, each set of levers being independently moveable and with independently variable resistance from the other, note that this is resistance and not dampening, see column 1, lines 54-68. The first set of handlebars in Lynch '196 are placed at about waist height and the second set is placed at a height which would be about shoulder height or higher, furthermore, the upper set of handlebars enables the operator to lift the load by pushing in an upward position (pressing) as opposed to lifting or pulling upward which is done with the lower set of handlebars. Means in Lynch '196 are also provided to prevent the handlebars from dropping below essentially a horizontal position. In Lynch '196, hydraulic/pneumatic cylinders, springs, elastic bands or other suitable devices may be used as the resistance means and are selectively variable for both the upper and lower sets of levers independently, see column 2, lines 24-36. Primarily designed to be used in a weightless environment the multiple handlebar sets in Lynch '196 are operational to provide resistance through cylinders 60, 62, 94, and 96, however, as in Lynch '561 the exercise criterion are arbitrary as opposed to experimental relationships tied to definitive results, also there is no dampening disclosed for a grasp by the user.

There exists a need to provide an exercise apparatus that can facilitate the dynamically selective loading/unloading of the user's static and dynamic weight load force placed upon their arms, back, legs, and feet. This would entail an added feature to a pivoting foot platform for example, that could have dampened pivotal movement, however, not being limited to just a pivot foot platform with any type of lower body portion exercise machine could be utilized as well, wherein a grasping handle element would be available to the user for instantaneously adjusting the load split as between their upper and lower body portions while using the exercise machine. Furthermore, it would be desirable for the grasping element to have a pivoting feature to allow limited movement in a controlled manner of the grasping handle element to accommodate another foot based exercise such as a mini-tramp wherein the handle would soften the impact load upon the physical skeletal structure and joints of the user's upper body portion in addition to adding stability and support to keep the user from losing their balance during their foot (and leg) based exercise. In summary, the primary feature would be to allow the user of the exercise machine, preferably a pivotal foot platform to use the grasping element at will and to also vary the amount of force loading split as between the user's upper and lower body portion, or to have no split in loading at all as between the upper and lower body portions, also at will.

SUMMARY OF THE INVENTION

An exercise apparatus is disclosed for rotational and vertical movement, the exercise apparatus including a base having a lengthwise axis, the base further including a stabilizing foot extending substantially perpendicular to the lengthwise axis, further included is a support beam having a longitudinal axis, the support beam including a proximal end portion and an opposing distal end portion with the longitudinal axis disposed therebetween, wherein the proximal end portion extends from the base. Further included in the exercise apparatus is a suspension handle that is disposed adjacent to the distal end portion and a platform that has a first pivotal attachment to the base, the platform having a first pivotal movement relative to the base about a first pivotal axis that is parallel to the longitudinal axis. Wherein operationally on the exercise apparatus an individual standing on the platform can simultaneously grasp the suspension handle to initiate a whole body twisting motion via the first pivotal movement situated as between the suspension handle and the pivoting platform with the ability to add a pull up type exercise using the suspension handle, wherein the suspension handle provides added stability and support to the individual for effecting a soft skeletal joint vertical support that is variable at will.

BRIEF DESCRIPTION OF DRAWINGS

FIG. 8 is an expanded cross sectional view 8-8 from FIG. 2, wherein FIG. 8 shows the dampening element that utilizes the optionally selectable dampening element of the plurality of adjacent disc surfaces that are compressed as against one another by selectable compressive force levels, wherein dampening is provided for the first pivotal movement of the foot platform, in addition to the elastomeric material for the means for centering the disc surfaces; and FIG. 9 is an expanded cross sectional view 9-9 from FIG. 2, wherein FIG. 9 shows the dampening element that utilizes the optionally adjustable spring element dampening element of the plurality of adjacent disc surfaces that are compressed as against one another by selectable compressive force levels, wherein dampening is provided for the pivotal movement of the foot platform, in addition to the elastomeric material for the means for centering the disc surfaces.

REFERENCE NUMBERS IN DRAWINGS

Figure 1:
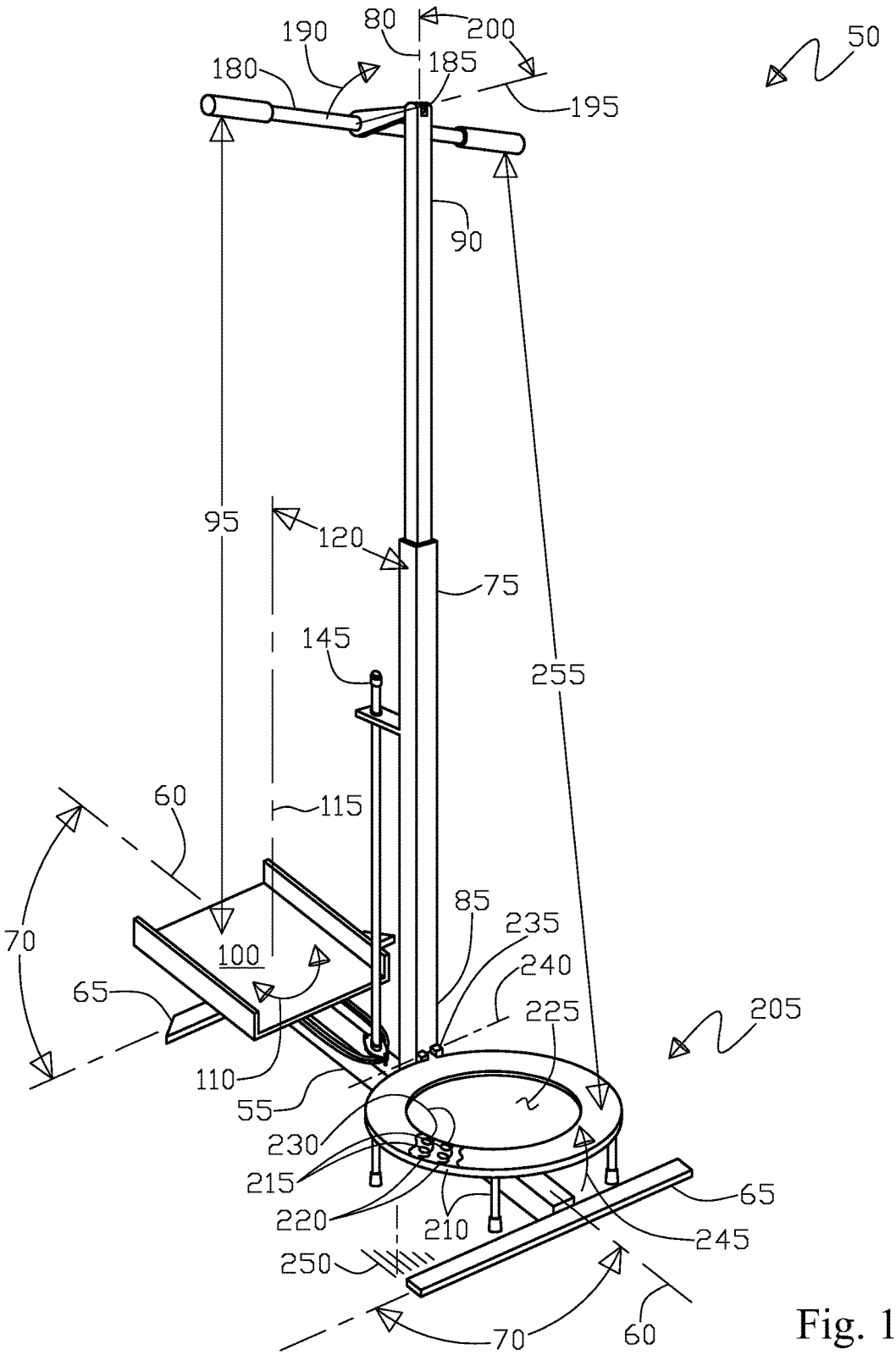
FIG. 1 is a perspective view of the exercise apparatus that is adapted to provide specific overhead grasping support for a user of a pivotal foot platform that can have the pivotal platform first movement dampened, or a means for rebounding with the grasping support able to flip in a second pivotal manner that is directly suspended over either the pivotal foot platform or the means for rebounding, also shown is the exercise apparatus base, foot, and support beam.

50 Exercise Apparatus
55 Base
60 Lengthwise axis of the base 55
65 Stabilizing foot of the base 55
70 Perpendicular relationship as between the stabilizing foot 65 and the lengthwise axis 60
75 Support beam
80 Longitudinal axis of the support beam 75
85 Proximal end portion of the support beam 75
90 Distal end portion of the support beam 75

95 First vertical distance of the support beam 75 that is essentially suspending the handle 180 over the platform 100 or the means for rebounding 205
100 Platform
105 First pivotal attachment of the platform 100 to the base 55
110 First pivotal movement of the platform 100
115 First pivotal axis of the platform 100 first pivotal attachment 105
120 Parallel relationship between the first pivotal axis 115 and the longitudinal axis 80
125 Dampening element for the first pivotal movement 110 of the platform 100
126 Means for linking the pivoting 110 platform 100 to the drive shaft 127
127 Drive shaft of the dampening element 125
128 Housing of the dampening element 125
129 Means for centering the disc surfaces 130
130 Plurality of disc surfaces of the dampening element 125
135 Force compressing as applied to the dampening element 125 that can be fixed or selectively variable as applied to the plurality of disc surfaces 130
140 Dynamic dampening coefficient of friction between the plurality of disc surfaces 130
145 Selective control of an amount of dampening compressive force for the dampening element 125, wherein the amount of dampening is preferably in units of ((pounds force–seconds)/inch) being termed the dynamic dampening coefficient 140
150 First pivotal movement 110 of the dampening element 125 via the means of linking 126
155 Relative first movement 150 of the plurality of disc surfaces 130 to one another
160 Sacrificial friction disc of the dampening element 125
165 Hard disc of the dampening element 125
170 Spring element of the dampening element 125
175 Selectively adjustable spring element
180 Suspension handle for support
185 Second pivotal attachment of the suspension handle 180
190 Second pivotal flip movement of the suspension handle 180
195 Second pivotal axis of the suspension handle 180
200 Perpendicular position of the second pivotal axis 195 to both the lengthwise axis 60 and the longitudinal axis 80
205 Means for rebounding
210 Peripheral frame that is inwardly open
215 Plurality of resilient elements
220 Third pivotal attachment of each one of the plurality of resilient elements 215 to the peripheral frame 210
225 Flexible mat
230 Fourth pivotal attachment of each one of the plurality of resilient elements 215 to the flexible mat 225
235 Fifth pivotal attachment between the peripheral frame 210 and the proximal end portion 85 of the support beam 75
240 Fifth pivotal axis of the fifth pivotal attachment 235
245 Fifth pivotal movement of the peripheral frame 210
250 Surface
255 Second vertical distance of the support beam 75
260 Individual exercising user
265 Positioning the individual 260 to be standing upon the platform 100
270 Positioning the individual 260 to be standing upon the means for rebounding 205
275 Grasping the suspension handle 180 by the individual 260
280 Rotational movement of the individual 260
285 Whole body twisting motion of the individual 260
290 Vertical movement of the individual 260
295 Pull up type exercise by the individual 260
300 Assisted pull up type exercise by the individual 260
305 Rebound movement of the individual 260 exercising

DETAILED DESCRIPTION

Figure 2:
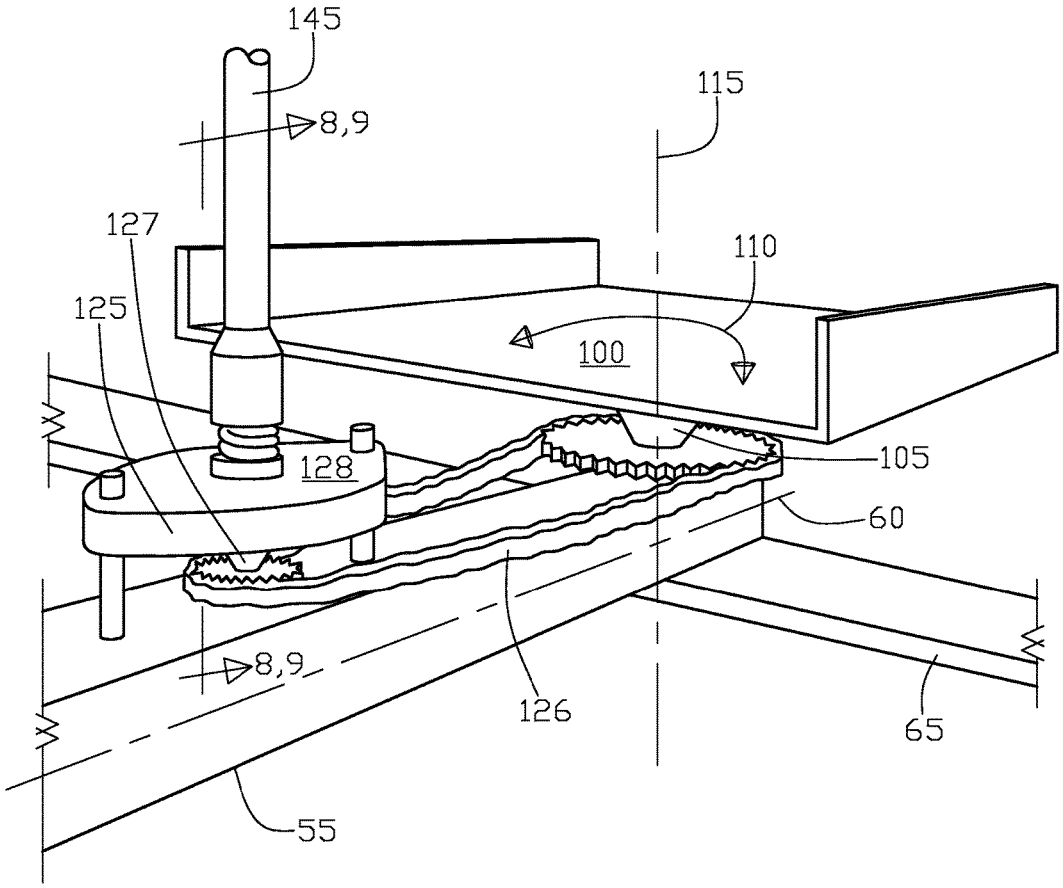
FIG. 2 is a perspective view close-up of the dampening element that selectively dampens the first pivotal movement of the first pivotally attached foot platform of the exercise apparatus that also includes the base and foot.

With initial reference to FIG. 1 shown is a perspective view of the exercise apparatus 50 that is adapted to provide specific overhead grasping 275 support 180 for a user 260 of a first pivotal 105 attached foot platform 100 that can have the first pivotal platform movement 110 dampened 125, or a means for rebounding 205 with the grasping 275 support 180 able to flip 190 in a pivotal manner 185 that is directly suspended 95 over either the pivotal 110 foot platform 100 or the means for rebounding 205, also shown in the exercise apparatus 50 base 55, foot 65, and support beam 75. Continuing, FIG. 2 is a perspective view close-up of the dampening element 125 that selectively dampens the first pivotal movement 110 of the first pivotally attached 105 foot platform 100 of the exercise apparatus 50 that also includes the base 55 and foot 65.

Figure 3:
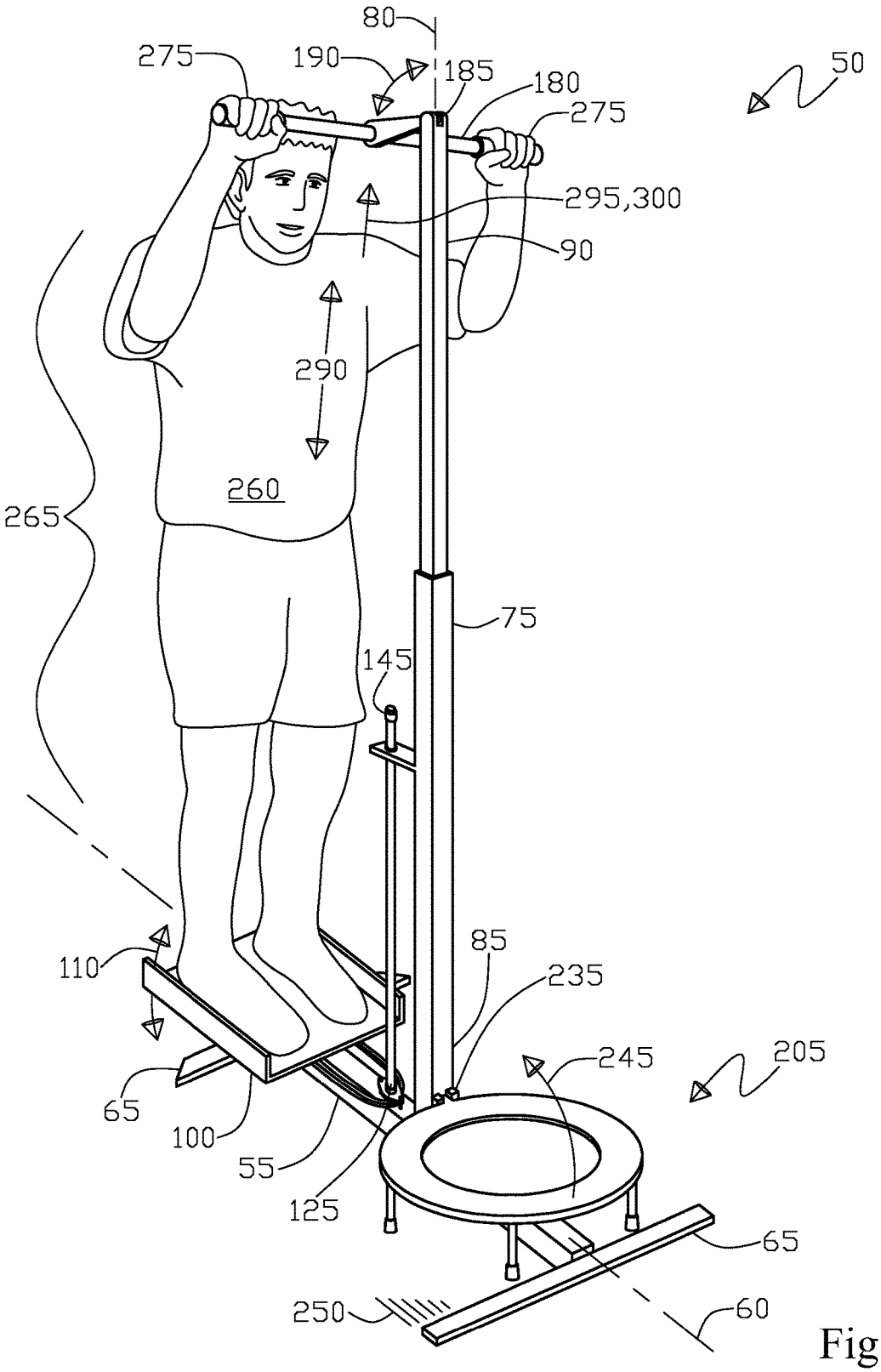
FIG. 3 basically shows the view of the exercise apparatus as in FIG. 1, that further includes the user that is standing on the first pivotally attached foot platform and grasping the suspension handle to start an exercise sequence of vertical movement.

Next, FIG. 3 basically shows the view of the exercise apparatus 50 as in FIG. 1, that further includes the user 260 that is standing on the first pivotally attached 105 foot platform 100 and grasping 275 the suspension handle 180 to start an exercise sequence of vertical movement 290, 295, 300. Further, FIG. 4 basically shows a sequential follow-up to FIG. 3, that further includes the user 260 that is pivoting in the first pivotal movement 110 upon the first pivotally attached 105 foot platform 100 with rotational movement 280 and whole body twisting motion 285 while continuing to grasp 275 the suspension handle 180 while simultaneously performing the exercise sequence of vertical movement 290, 295, 300.

Figure 5:
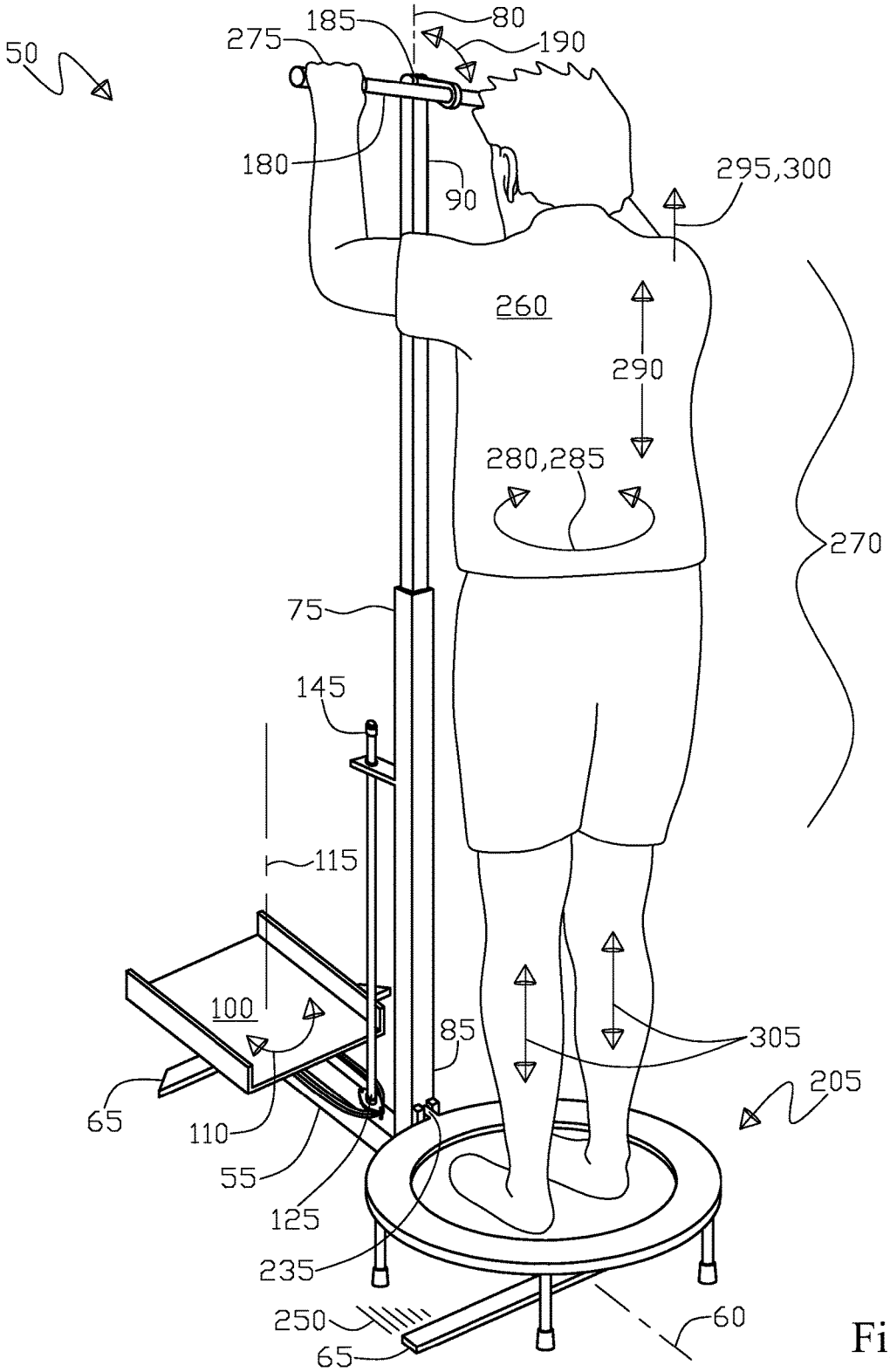
FIG. 5 shows the user engaging the means for rebounding via jumping upon the means for rebounding, that further includes the user pivoting upon the means for rebounding from a lower position and combining the whole body twisting motion while to grasping the suspension handle while starting to execute a vertical upward movement.
Figure 6:
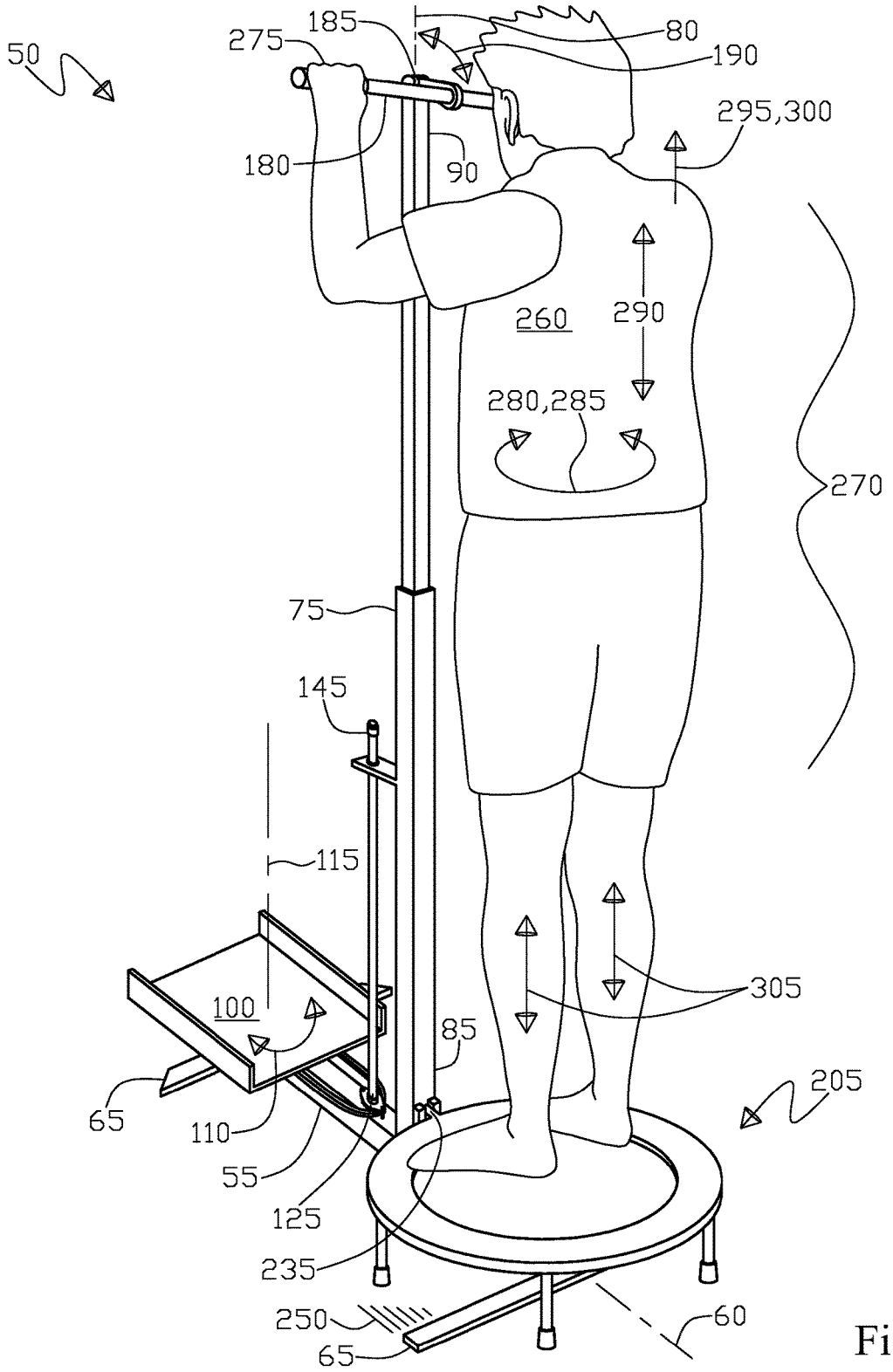
FIG. 6 shows a sequential follow-up to FIG. 5 with the user propelling vertically upward from the means for rebounding via jumping upon the means for rebounding, that further includes the user pivoting upon the means for rebounding from a lower position to a higher position and combining the whole body twisting motion while grasping the suspension handle for support stability and as a way to execute the whole body twisting motion.

Moving onward, FIG. 5 shows the user 260 engaging the means for rebounding 205 via jumping 305 upon the means for rebounding 205, that further includes the user 260 pivoting upon the means for rebounding 205 from a lower position and combining the whole body twisting motion 285 while grasping 275 the suspension handle 180 while starting to execute a vertical upward movement 290. Yet further, FIG. 6 shows a sequential follow-up to FIG. 5 with the user 260 propelling vertically upward 290, from the means for rebounding 205 via jumping 305 upon the means for rebounding 205, that further includes the user 260 pivoting 280 upon the means for rebounding 205 from a lower position to a higher position and combining the whole body twisting motion 285 while grasping 275 the suspension handle 180 for support stability and as a way to execute the whole body twisting motion 285.

Figure 7:
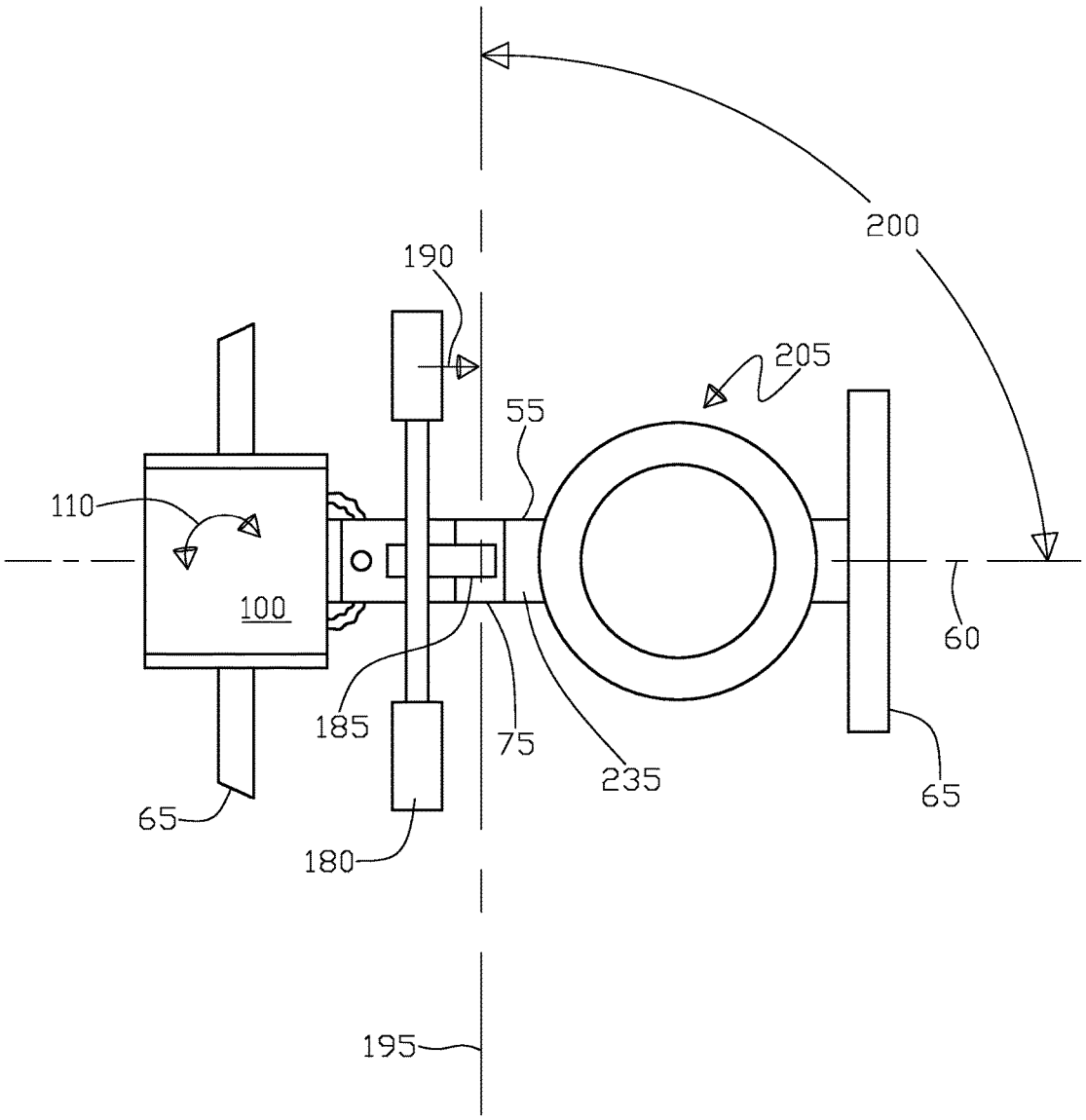
FIG. 7 shows a top view of the exercise apparatus with the base, foot, support beam, plus the first pivotally attached foot platform, the suspension handle, plus the fifth pivotally attached means for rebounding that is in the form of a mini-trampoline.
Figure 8:
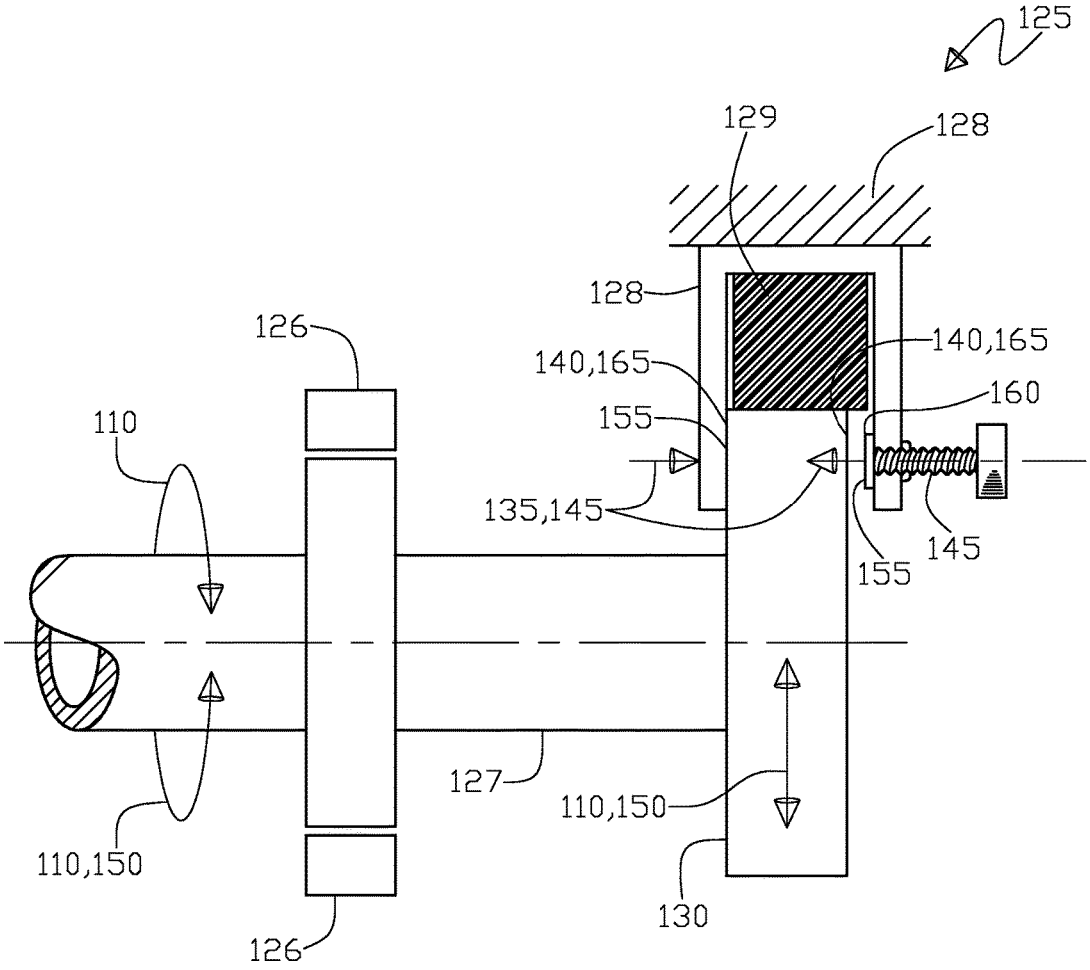

Next, FIG. 7 shows a top view of the exercise apparatus 50 with the base 55, foot 65, support beam 75, plus the first pivotally attached 105 foot platform 100, the suspension handle 180, plus the fifth pivotally attached 235 means for rebounding 205 that is in the form of a mini-trampoline. Continuing, FIG. 8 is an expanded cross sectional view 8-8 from FIG. 2, wherein FIG. 8 shows the dampening element 125 that utilizes the optionally selectable 145 dampening element of the plurality of adjacent disc surfaces 130 that are compressed as against one another by selectable compressive force levels 135, wherein dampening is provided for the first pivotal movement 110 of the foot platform 100, in addition to the elastomeric material that is preferably used for the means for centering 129 the disc surfaces 130, wherein the means in mounted in a housing 128. Next, FIG.

Figure 9:
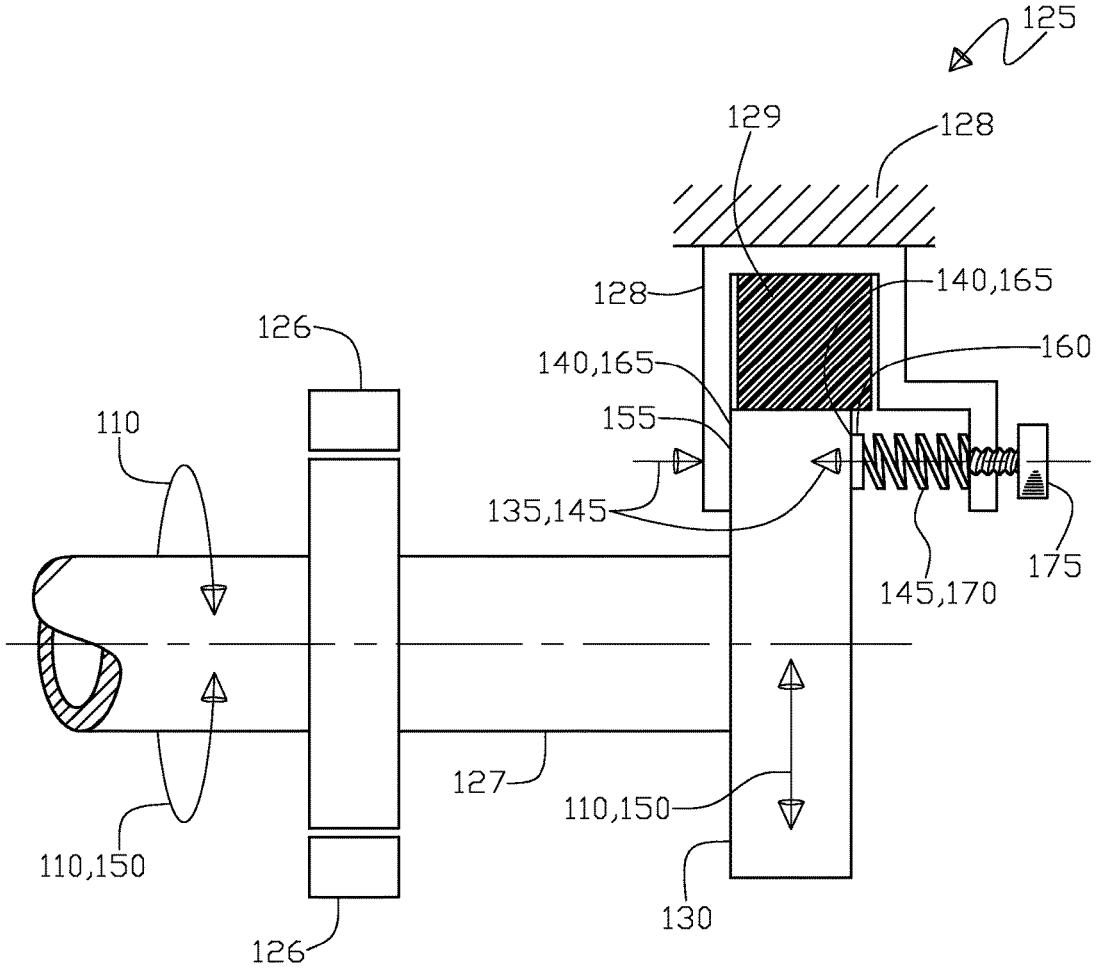

9 is an expanded cross sectional view 9-9 from FIG. 2, wherein FIG. 9 shows the dampening element 125 that utilizes the optionally adjustable spring element 175 dampening element of the plurality of adjacent disc surfaces 130 that are compressed as against one another by selectable compressive force levels 135, wherein dampening is provided for the first pivotal movement 110 of the foot platform 100, in addition to the elastomeric material that is preferred for the means for centering 129 the disc surfaces 130.

Figure 4:
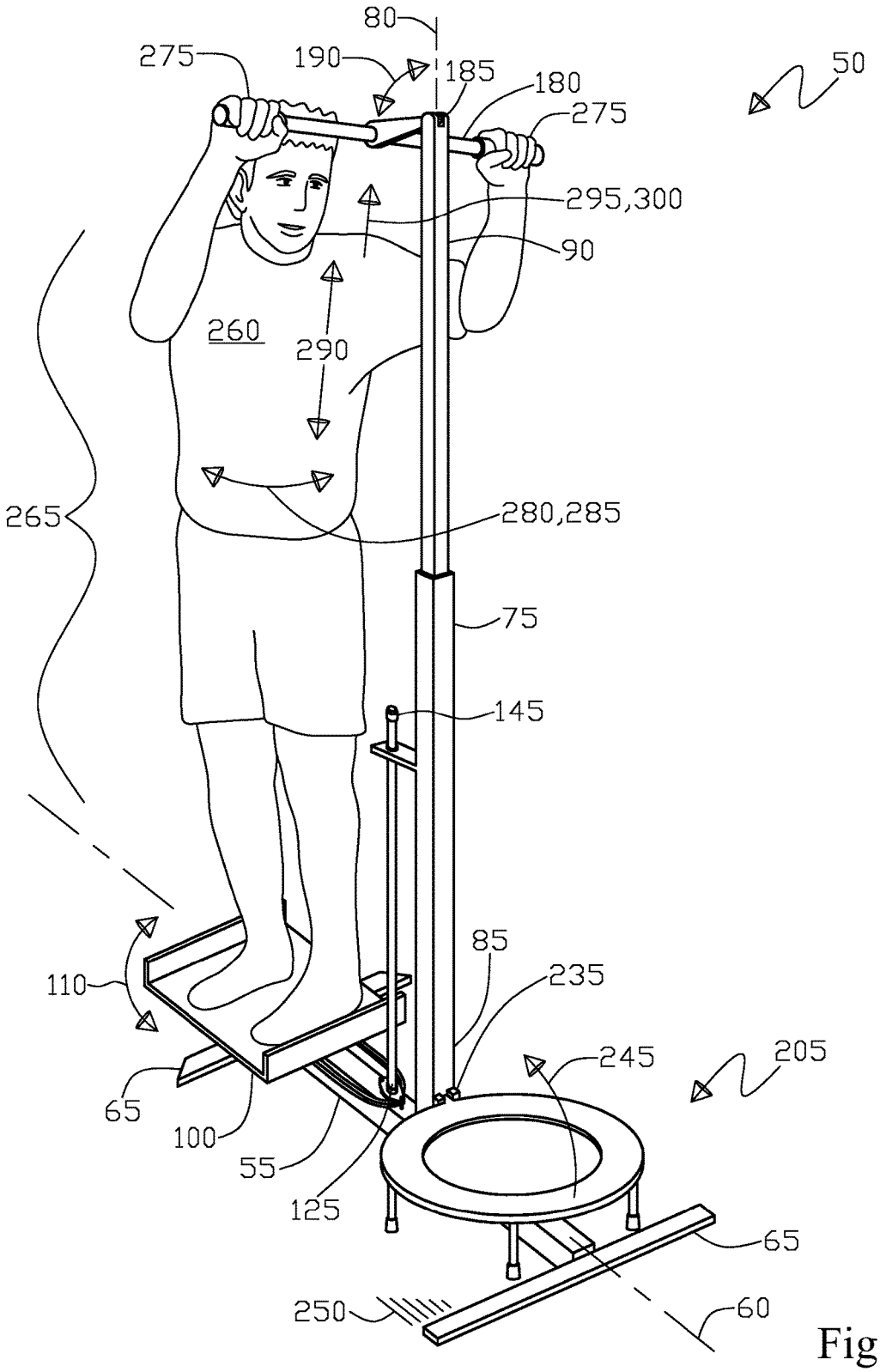
FIG. 4 basically shows a sequential follow-up to FIG. 3, that further includes the user that is pivoting in a first pivotal movement upon the first pivotally attached foot platform with rotational movement and whole body twisting motion while continuing to grasp the suspension handle while simultaneously performing the exercise sequence of vertical movement.

In looking at the FIGS. 1, 3, and 4, for the exercise apparatus 50 for an individual exercising 260 having rotational 280, 285 and vertical 290, 295, 300 movement, the exercise apparatus 50 including a base 55 having a lengthwise axis 60, the base 55 further including a stabilizing foot 65 extending substantially perpendicular 70 to the lengthwise axis 60. Further included in the exercise apparatus 50 is a support beam 75 having a longitudinal axis 80, the support beam 75 including a proximal end portion 85 and an opposing distal end portion 90 with the longitudinal axis 80 disposed therebetween, wherein the proximal end portion 85 extends from the base 55. Further included in the exercise apparatus 55 is a suspension handle 180 that is disposed adjacent to the distal end portion 90 and a platform 100 that has a first pivotal attachment 105 to the base 55. The platform 100 having a first pivotal movement 110 relative to the base 55 about a first pivotal axis 115 that is parallel 120 to the longitudinal axis 80. Wherein operationally, on the exercise apparatus 50 an individual 260 standing on the platform 100 can simultaneously grasp 275 the suspension handle 180 to initiate a whole body twisting motion 280, 285 via the first pivotal movement 110 situated as between the suspension handle 180 and the pivoting 110 platform 100 with the ability to add a pull up type exercise 290, 295, 300 using the suspension handle 180, wherein the suspension handle 180 provides added stability and support to the individual 260 for effecting a soft skeletal joint vertical support that is variable at will, see FIGS. 3 and 4 in particular.

Alternatively, for the exercise apparatus 50, wherein the support beam 75 distal end portion 90 and the suspension handle 180 are structurally extended to be above the platform 100 to define a first vertical distance 95 along the longitudinal axis 80 that is greater than a height of the individual 260, thus operationally forcing the individual 260 to grasp the suspension handle 180 in an overhead manner, as best shown in FIGS. 1, 3, 4, 5, and 6.

As an option for the exercise apparatus 50, it can further comprise a first pivotal movement 110 dampening element 125 that is disposed as between the platform 100 and the base 55, see FIGS. 2, 8, and 9 primarily, and FIGS. 2, 3, and 4 secondarily. Wherein the dampening element 125 is operational to dampen the first pivotal movement 110 thus operationally adding resistance to the first pivotal movement 110 to add exercise effort to the whole body twisting motion 285 for additional user 260 exercise, see FIGS. 3 and 4 in particular. Further, for the dampening element 125 on the exercise apparatus 50 wherein the dampening element 125 is preferably constructed by applying a force 135 compressing a plurality of disc surfaces 130 to one another so as to have a dynamic coefficient of friction 140 between the plurality of disc surfaces 130 that have the first pivotal movement 150 relative to one another, wherein a selectable control 145 of the first pivotal movement 150 between the plurality of disc surfaces 130 results in a control of the dampening element 125 first pivotal movement 150. Continuing, the dampening element 125 is preferably sized and configured to be selectively adjustable 145 for the dampening units of (pounds force–seconds)/inch, being defined as a dampening coefficient 140, see FIGS. 2, 8, and 9.

Further, on the optional dampening element 125, wherein the selectively adjustable 145 dampening element 125 accomplishes dampening adjustment by preferably a selectively variable force 135 compressing the plurality of disc surfaces 130 to one another so as to vary the dampening coefficient 140 between the plurality of disc surfaces 130 that have a first movement 155 relative to one another, wherein the control of the first movement 155 between the plurality of disc surfaces 130 results in a control of the first dampening element movement 150. Additionally, on the optional dampening element 125 it can include for the dampening element plurality of disc surfaces 130 a sacrificial friction disc 160 adjacent to a hard disc 165 and a spring element 170 to maintain a substantially constant compressing force 135 as the friction disc wears 160 over time. Plus, on the optional dampening element 125 the spring element 170 can include a selectively adjustable spring element 175 to create the selectively variable 145 compressing force 135. Further, the optional dampening element 125 can utilize a remote means for linking 126 the first pivotal movement 110 of the platform 100 to the drive shaft end 127 of the dampening element 125, as shown primarily in FIG. 2, and also shown in FIGS. 1, 3, and 4, plus in detail in FIGS. 8 and 9. The means for linking 126 is preferably a belt, however, it could be a chain, or a suitable equivalent.

Another option for the exercise apparatus 50 is that it can include a means for rebounding 205 that is positioned adjacent to the base 55, wherein the means for rebounding 205 is operational to allow an individual user 260 to jump on the means for rebounding 205 while grasping 275 the suspension handle 180 with the ability to add an assisted pull up type exercise 290, 295, 300 using the suspension handle 180, wherein the suspension handle 180 provides added stability and support to effect a soft skeletal joint vertical support that is variable at will, see FIGS. 5 and 6. Note that the means for rebounding 205 can be used in combination with the platform 100 or the means for rebounding 205 can be used without the platform 100 present, further the platform 100 can be used without the means for rebounding 205. Further, optionally on the exercise apparatus 50 the support beam 75 distal end portion 90 and the suspension handle 180 are structurally extended to be above the means for rebounding 205 to define a second vertical distance 255 along the longitudinal axis 80 that is greater than a height of the individual 260, thus operationally forcing the individual 260 to grasp 275 the suspension handle 180 in an overhead manner, as best shown in FIGS. 5 and 6.

As a further option on the exercise apparatus 50 the suspension handle 180 can have a second pivotal attachment 185 to the distal end portion 90 such that the second pivotal attachment 185 has a second pivotal axis 195 that is positioned perpendicular 200 to both the lengthwise 60 and the longitudinal 80 axes. The suspension handle 180 is operational to have a second pivotal movement 190 from being suspended over the platform 100 to being suspended over the means for rebounding 205 thus giving the individual user 260 free access to the suspension handle 180 either over the platform 100 or the means for rebounding 205, see FIGS. 1, 3, 4, 5, 6, and 7.

In addition, on the means for rebounding 205; it is preferably a trampoline that is constructed of an inwardly open peripheral frame 210 that is supported above a surface 250, the frame 210 includes a plurality of third pivotally attached 220 resilient elements 215 facing inwardly, wherein the resilient elements 215 are oppositely fourthly pivotally attached 230 to a flexible mat 225 to suspend the mat 225 over the surface 250 and proximate to the frame 210, see in particular FIGS. 1, 3, 4, 5, and 6. Also, on the means for rebounding 205; it can have a fifth pivotal attachment 235 having a fifth pivotal axis 240 between the trampoline frame 210 and the proximal end portion 85, being operational via a fifth pivotal movement 245 to move the trampoline mat 225 from being parallel to the lengthwise axis 60 to being parallel to the longitudinal axis 80 for storage, see FIGS. 3 and 4.

Method of Use

Referring in particular to FIGS. 3, 4, 5, and 6, a method of using an exercise apparatus 50 for the user 260 exercises of rotational 280, 285 and vertical movement 290, 295, 300, is disclosed that includes the steps of firstly providing the exercise apparatus 50 as previously described utilizing the platform 100 without the means for rebounding 205. Next, a second step of positioning 265 the individual 260 to be standing upon the platform 100, see FIG. 3, a subsequent third step of grasping 275 the suspension handle 180 by the individual 260, and a fourth step of initiating the whole body twisting motion 285 for exercise by the individual 260 as situated between the suspension handle 180 and the first pivotal movement 110 pivoting platform 100 via using the suspension handle 180 to twist 280, 285 against, see FIGS. 3 and 4. An optional added step of a pulling up type exercise 290, 295, 300 using the suspension handle 180 in combination with the twisting motion exercise 280, 285, wherein the suspension handle 180 provides added stability and support to the individual 260 for effecting a soft skeletal joint vertical support that is variable at will, see FIGS. 3 and 4.

Referring to FIGS. 5 and 6, a method of using an exercise apparatus 50 for rotational 280, 285 and vertical movement 290, 295, 300, for the user 260 exercises includes the step of firstly providing the exercise apparatus 50 as previously described utilizing the means for rebounding 205 without the platform 100. Next, a second step of positioning 270 the individual 260 to be standing upon the means for rebounding 205, see FIG. 5. A subsequent third step of grasping 275 the suspension handle 180 by the individual 260, and a fourth step of initiating the whole body vertical bouncing motion 290, 295, 300 for exercise by the individual 260 as situated between the suspension handle 180 and the means for rebounding 205 via using the suspension handle 180 to pull up 295 against and stabilize the individual's 260 vertical bouncing motion on the means for rebounding 205, wherein the suspension handle 180 provides added stability and support to effect a soft skeletal joint vertical support that is variable at will, see FIGS. 5 and 6.

CONCLUSION

Accordingly, the present invention of an exercise apparatus and method of using the same has been described with some degree of particularity directed to the embodiments of the present invention. It should be appreciated, though, that the present invention is defined by the following claims construed in light of the prior art so modifications the changes may be made to the exemplary embodiments of the present invention without departing from the inventive concepts contained therein.

The invention claimed is:

1. An exercise apparatus for rotational and vertical movement, said exercise apparatus, comprising:

(a) a base having a lengthwise axis, said base further including a stabilizing foot extending substantially perpendicular to said lengthwise axis;

(b) a support beam having a longitudinal axis, said support beam including a proximal end portion and an opposing distal end portion with said longitudinal axis disposed therebetween, wherein said proximal end portion extends from said base;

(c) a suspension handle that is disposed adjacent to said distal end portion;

(d) a platform that has a first pivotal attachment to said base, said platform having a first pivotal movement relative to said base about a first pivotal axis that is parallel to said longitudinal axis, wherein operationally an individual standing on said platform can simultaneously grasp said suspension handle to initiate a whole body twisting motion via said first pivotal movement situated as between said suspension handle and said pivoting platform with the ability to add a pull up type exercise using said suspension handle, wherein said suspension handle provides added stability and support to the individual for effecting a soft skeletal joint vertical support that is variable at will, wherein said support beam distal end portion and said suspension handle are structurally extended to be above said platform to define a first vertical distance along said longitudinal axis in going from said proximal end portion to said distal end portion, thus operationally forcing the individual to grasp said suspension handle in an overhead manner; and (e) a means for rebounding that is positioned adjacent to said base, said means for rebounding is operational to allow an individual user to jump on said means for rebounding while grasping said suspension handle with the ability to add an assisted pull up type exercise using the suspension handle, wherein said suspension handle provides added stability and support to effect a soft skeletal joint vertical support that is variable at will, said support beam distal end portion and said suspension handle are structurally extended to be above said means for rebounding to define a second vertical distance along said longitudinal axis in going from said proximal end portion to said distal end portion, thus operationally forcing the individual to grasp said suspension handle in an overhead manner, wherein said suspension handle has a second pivotal attachment to said distal end portion such that said second pivotal attachment has a second pivotal axis that is positioned perpendicular to both said lengthwise and said longitudinal axes, said suspension handle is operational to have a second pivotal movement from being suspended over said platform to being suspended over said means for rebounding thus giving the individual user free access to said suspension handle either over said platform or said means for rebounding.

2. The exercise apparatus according to claim 1 further comprising a first pivotal movement dampening element that is disposed as between said platform and said base, wherein said dampening element is operational to dampen said first pivotal movement thus operationally adding resistance to said first pivotal movement to add effort to the whole body twisting motion for additional exercise.

3. The exercise apparatus according to claim 2 wherein said dampening element is constructed by applying a force compressing a plurality of surfaces to one another so as to have a dynamic coefficient of friction between said plurality of surfaces that have said first pivotal movement relative to one another, wherein a selectable control of said first pivotal movement between said plurality of surfaces results in a control of said dampening element first pivotal movement.

4. The exercise apparatus according to claim 3 wherein said dampening element is sized and configured to be selectively adjustable for the dampening units of (pounds force–seconds)/inch, being defined as a dampening coefficient.

5. The exercise apparatus according to claim 4 wherein said selectively adjustable dampening element accomplishes dampening adjustment by a selectively variable force compressing said plurality of surfaces to one another so as to vary said dampening coefficient between said plurality of surfaces that have a first movement relative to one another, wherein said control of said first pivotal movement between said plurality of surfaces results in a control of said first dampening element movement.

6. The exercise apparatus according to claim 5 wherein said dampening element plurality of surfaces includes a sacrificial friction disc adjacent to a hard disc and a spring element to maintain a substantially constant said compressing force as said friction disc wears.

7. The exercise apparatus according to claim 6 wherein said spring element includes a selectively adjustable spring element to create said selectively variable compressing force.

8. The exercise apparatus according to claim 1 wherein said means for rebounding is a trampoline that is constructed of an inwardly open peripheral frame that is supported above a surface, said frame includes a plurality of resilient elements facing inwardly, wherein each resilient element has a third pivotal attachment to said frame, further each said resilient element is oppositely fourthly pivotally attached to a flexible mat to suspend said mat over the surface and proximate to said frame.

9. The exercise apparatus according to claim 8 further comprising a fifth pivotal attachment having a fifth pivotal axis between said trampoline frame and said proximal end portion, being operational via a fifth pivotal movement to move said trampoline mat from being parallel to said lengthwise axis to being parallel to said longitudinal axis for storage.

* * * * *